United States Patent [19]

Mitzlaff et al.

[11] 4,288,300

[45] Sep. 8, 1981

[54] PROCESS FOR THE MANUFACTURE OF N-α-ALKOXYETHYL-CARBOXYLIC ACID AMIDES

[75] Inventors: Michael Mitzlaff, Bad Homburg; Jürgen Cramer, Eppstein; Rudolf Pistorius, Ober-Mörlen, all of Fed. Rep. of Germany

[73] Assignee: Hoechst Aktiengesellschaft, Frankfurt am Main, Fed. Rep. of Germany

[21] Appl. No.: 149,149

[22] Filed: May 14, 1980

[30] Foreign Application Priority Data

May 16, 1979 [DE] Fed. Rep. of Germany ..... 2919756

[51] Int. Cl.[3] ..... C25B 3/02; C25B 11/12

[52] U.S. Cl. ..... 204/59 R; 204/72; 204/79

[58] Field of Search ..... 204/59 R, 72, 79

[56] References Cited

U.S. PATENT DOCUMENTS

| | | | |
|---|---|---|---|
| 3,193,483 | 7/1965 | Baizer et al. | 204/73 |
| 3,941,666 | 3/1976 | Mitzlaff et al. | 204/79 |
| 4,036,712 | 7/1977 | Mitzlaff | 204/59 R |
| 4,140,593 | 2/1979 | Mitzlaff | 204/59 R |
| 4,149,941 | 4/1979 | Mitzlaff et al. | 204/59 R |

FOREIGN PATENT DOCUMENTS

| | | |
|---|---|---|
| 2336976 | 2/1975 | Fed. Rep. of Germany . |
| 2539767 | 3/1977 | Fed. Rep. of Germany . |

*Primary Examiner*—F. Edmundson

*Attorney, Agent, or Firm*—Curtis, Morris & Safford

[57] ABSTRACT

N-α-alkoxyethyl-carboxylic acid amides are prepared by anodic alkoxylation of N-ethyl-carboxylic acid amides with an alcohol in an electrolytic cell using vitreous carbon as anode material and at least one alkali metal and/or tetraalkyl-ammonium alkosulfate as supporting electrolyte.

13 Claims, 1 Drawing Figure

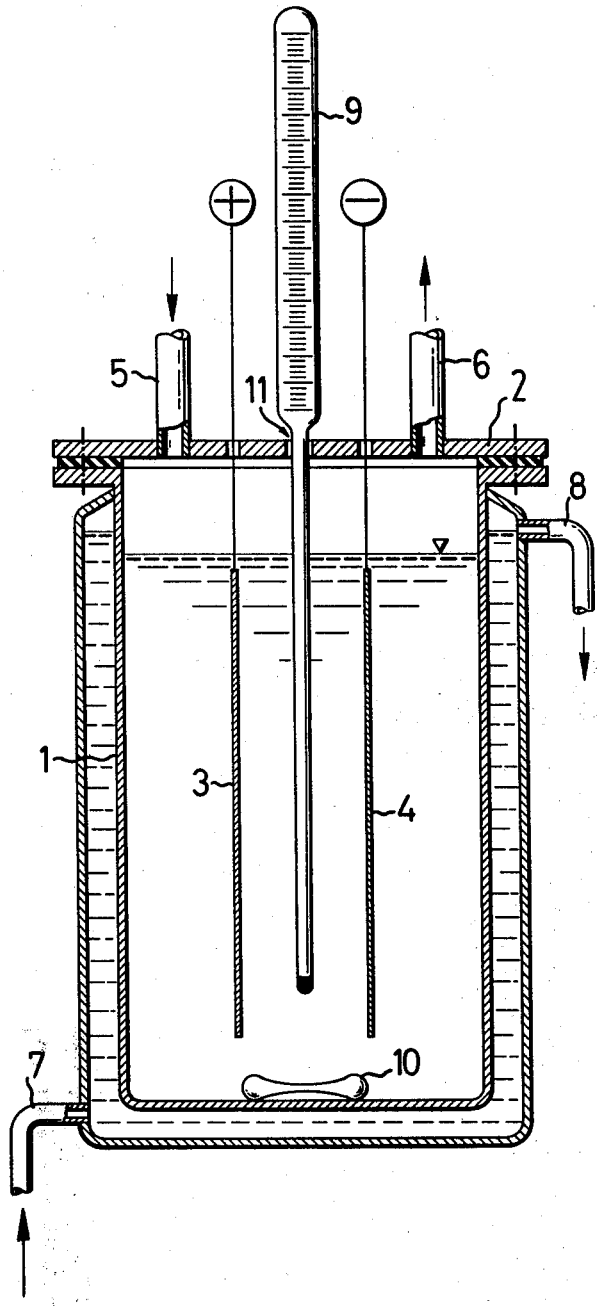
9
5
6
11
2
8
1
3
4
7
10

PROCESS FOR THE MANUFACTURE OF N-α-ALKOXYETHYL-CARBOXYLIC ACID AMIDES

N-α-alkoxyethyl-carboxylic acid amides are valuable intermediates, especially for the manufacture of N-vinylcarboxylic acid amides (cf. DE-OS 2,336,977), which can be reacted to give water-soluble polymers having interesting and versatile utilitarian properties (cf. Ullmanns Enzyklopädie der Technischen Chemie, 3rd edition, volume 14, pages 261 to 264).

It has been proposed to manufacture N-α-alkoxyethyl-carboxylic acid amides by an electrochemical process. According to the process described in DE-OS No. 2,113,338 N-alkylated carboxylic acid amides of the formula I

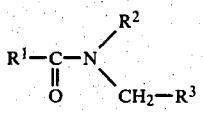

(I)

in which $R^1$ is hydrogen, $C_1$–$C_6$ alkyl or $C_6$–$C_{10}$ aryl $R^2$ is hydrogen, $C_2$–$C_6$alkyl, or $R^1$ and $R^2$ together denote $C_2$–$C_6$alkylene which is optionally substituted by $C_1$–$C_4$alkyl, $R^3$ is hydrogen or $C_1$–$C_6$ alkyl are electrolyzed, in the presence of a supporting electrolyte at a temperature of from +10° C. to 100° C., with alcohols of the formula II $R^4(OH)_n$ in which $R^4$ is $C_1$–$C_6$alkyl, $C_1$–$C_6$alkylene, $C_4$–$C_7$cycloalkyl or $C_4$–$C_7$-cycloalkylene and n is 1 or 2.

The electrodes used in this process are made from nets or sheets of Pd or Pt or from metal coated with noble metal or mixed oxides, titanium electrodes being preferred.

As supporting electrolytes there are used, in the first place, salts containing as cation the ammonium, alkali metal or tetraalkyl ammonium ion carrying $C_1$–$C_6$ alkyl groups, the nitryl or nitrosyl ion, and as anion the nitrate or chloride ion or oxygen bound in complex form with P, Cl, Br or I as central atom or F bound in complex form with P, B, Ti, Sb, As, Sn, or Si as central atom. As supporting electrolytes there are especially mentioned ammonium or alkali metal nitrate, ammonium or alkali metal hexafluorophosphate, hexafluorotitanate, hexafluorosilicate, hexafluoroantimonate, hexafluoroarsenate, tetrafluoroborate, trifluorostannate, or perchlorate, tetraalkylammonium tetrafluoroborate, or tetraalkylammonium chloride with $C_1$–$C_6$alkyl groups.

In the aforesaid patent specification it is recommended to carry out the electrolysis to less than complete conversion of the reactants since the cell voltage increases by the product formation whereby the substance yield and current efficiency decrease. This is the reason why the quantity of electricity in this process does not exceed 2.4 Faraday per mol carboxylic acid amide.

The use of higher current amounts is possible and even advantageous if very special starting substances as listed in DE-OS No. 2,113,338, namely N-ethylcarboxylic acid amides of the formula III

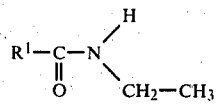

(III)

in which $R^1$ is as defined under formula I, are electrolyzed in the presence of specific supporting electrolytes, i.e. quaternary ammonium or alkali metal salts of tetrafluoroboric acid and/or hexafluorophosphoric acid, to the corresponding N-α-alkoxyethyl-carboxylic acid amides (cf. BE-PS No. 837,906). In this manner the substance yield is improved and the reaction mixture is easier to work up. The electrode materials used are the same as those mentioned in DE-OS No. 2,113,338.

A drawback of these quite advantageous electrochemical processes is the necessity to use expensive noble metals as electrode material. The cheaper (coated) titanium anodes are unstable in the non aqueous system (alcohols) used in these processes as soon as the electrolyte comes into contact with the base metal. Attempts to save noble metal by using same for the anodes only and by making the cathodes from non-noble metals (steel, nickel and so on) result, as shown by own experiments, in the presence of fluorine-containing supporting electrolytes (which proved to be the most advantageous supporting electrolytes in the electrochemical processes), and the formation of deposits on the cathodes which are insoluble in the electrolyte and which considerably impair or even stop the process.

It has, therefore, been desirable to find a cheap electrode material which is sufficiently stable in practice and which prevents the formation of disturbing and insoluble deposits on the electrodes for the electrochemical alkoxylation of N-ethyl-carboxylic acid amides to the corresponding N-α-alkoxyethyl-carboxylic acid amides.

A possible way to solve this problem seems to be the replacement of noble metal anodes by graphite anodes which are rather cheap and which are used in similar electrochemical processes, for example as described in DE-OS No. 2,336,976, BE-PS No. 845,901 and BE-PS No. 849,625.

According to DE-OS No. 2,336,976 N-α-alkoxyethyl-carboxylic acid amides IV are prepared by an electrochemical process by anodic alkoxylation of a partially neutralized N-acyl-α-aminopropionic acid V in alcoholic solution ($R^6OH$, VI) as follows:

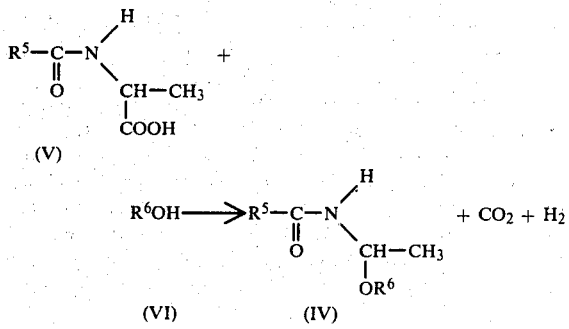

in which $R^5$ is hydrogen or lower alkyl and $R^6$ is lower alkyl. The reaction equation teaches that in this process $CO_2$ is formed which is not the case in the electrochemical alkoxylations according to the DE-OS No. 2, 113,338 mentioned above and BE-PS No. 837,906 and, therefore, this process cannot be directly compared with the processes referred to at the beginning.

In BE-PS No. 845,901 and BE-PS No. 849,625 the electrochemical alkoxylation of cyclic N-compounds to corresponding derivatives alkoxylated at the nucleus is described: BE-PS No. 845,901

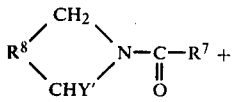

(VII)

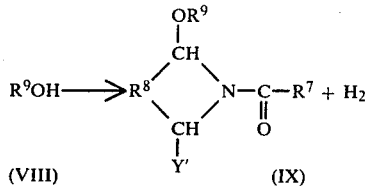

(VIII) (IX)

in which $R^7$ is hydrogen, $C_1$–$C_8$alkyl, $C_6$–$C_{10}$aryl, $C_1$–$C_4$alkoxy, aralkoxy or aryloxy, $R^8$ denotes a branched or linear alkylene group having 1 to 8 carbon atoms in the chain, $R^9$ is $C_1$–$C_4$alkyl and Y' is hydrogen, $C_1$–$C_4$alkyl or $C_1$–$C_4$alkoxy. BE-PS No. 849,625:

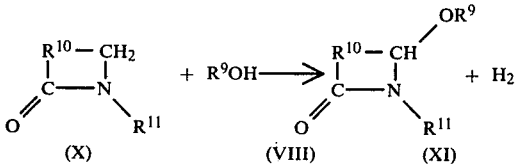

(X) (VIII) (XI)

in which $R^{10}$ denotes branched or linear alkylene with 1 to 10 carbon atoms in the chain and optionally substituted by reaction-inert groups, and $R^{11}$ is hydrogen or branched $C_3$–$C_{10}$alkyl with a secondary or tertiary N-α-C atom.

In the two processes alkali metal and tetraalkylammonium tetrafluoroborates, hexafluorophosphates and nitrates are used as supporting electrolytes.

It is not possible simply to transfer the conditions of an anodic alkoxylation of cyclic nitrogen compounds to the anodic alkoxylation of open-chain N-alkyl-carboxylic acid amides, since it is known that within the class of open-chain carboxylic acid amides under identical conditions of electrolysis—especially with the use of the same electrode material—absolutely different results can be obtained.

The anodic alkoxylation of dimethyl formamide to N-alkoxymethyl methyl formamide, for example, is possible without difficulty at Pt as well as at graphite anodes using tetrafluoroborates or nitrates as supporting electrolytes, whereas the anodic alkoxylation of N-(mono)methyl formamide to give N-alkoxymethyl formamide is successful under the same conditions only at a Pt anode and with tetrafluoroborates as supporting electrolytes (cf. M. Finkelstein and S. D. Ross, Tetrahedron, volume 28, pages 4497 to 4502, Pergamon Press 1972; S. D. Ross, M. Finkelstein and E. J. Rudd; Anodic Oxidation, pages 236 to 237, Academic Press 1975). When a graphite anode is used in the anodic oxidation of N-methyl formamide, it is mainly the alcohol used as solvent and alkoxylation reagent which is oxidized to the aldehyde, which, in turn, furnishes the corresponding acetal with the alcohol not yet oxidized.

This discovery is in conformity with the known fact that often very different results are obtained with electro-organic reactions at different anodes such as, for example, Pt and graphite anodes (cf. M. M. Baizer, Organic Electrochemistry, page 201, edited by Marcel Dekker, New York 1973).

Consequently, it could not be expected that the anodic oxidation of N-ethyl-carboxylic acid amides with an alcohol according to BE-PS No. 837,906 with the use of graphite anodes instead of the noble metal electrodes described in said specification would give the same result (N-α-alkoxyethyl-carboxylic acid amide). It is the same with the use of vitreous carbon instead of normal graphite, which does not differ chemically from normal graphite and which is also known as electrode material, the more so as all other properties important to the electrolysis such as porosity of the two materials are substantially equal (cf. N. L. Weinberg, Technique of Electroorganic Synthesis, volume V, part 1, page 19, edited by John Wiley and Sons 1976).

Considering the prior art it has, therefore, been extremely surprising that the electrochemical production of N-α-alkoxyethylcarboxylic acid amides by anodic alkoxylation of N-ethyl-carboxylic acid amides with alcohols using vitreous carbon as anode material and alkali metal and/or tetraalkyl-ammonium alkosulfates as supporting electrolytes is very successful. In this manner the above problem could be solved in excellent manner. It has been surprising that not only vitreous carbon could be used as anode material but also that the said supporting electrolytes could be used with success since alkosulfates (i.e. salts of semi-esters of sulfuric acid) are known as supporting salts for an entirely different electrochemical reaction, namely the electrochemical hydrodimerization of acrylonitrile to adipic acid dinitrile (cf. F. Beck "Electroorganische Chemie, Grundlagen und Anwendungen", Verlag Chemie 1974, page 109 and the primary literature cited therein by M. M. Beizer, J. Electrochemical Society 111, pages 215 to 222, especially 220 (1964) and US-PS No. 2,198,746). The combination of the special anode material with the special supporting electrolytes is obviously responsible for the surprising and advantageous success of the reaction.

It is, therefore, the object of the invention to provide a process for the manufacture of N-α-alkoxyethylcarboxylic acid amides by anodic alkoxylation of N-ethylcarboxylic acid amides with an alcohol in an electrolytic cell equipped with anode(s) and cathode(s) in the presence of a supporting electrolyte, which comprises using glassy or vitreous carbon as anode material and at least one alkali metal and/or tetraalkyl-ammonium alkosulfate as supporting electrolyte.

Suitable starting materials in the process of the invention are all possible aliphatic and aromatic N-ethylcarboxylic acid amides the amide nitrogen of which carries the ethyl group as the sole substituent. It is preferred to use N-ethyl-carboxylic acid amides of the formula III as used in BE-PS No. 837,906

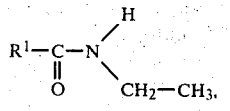

(III)

in which $R^1$ is hydrogen, $C_1$–$C_6$ alkyl or $C_6$–$C_{10}$ aryl, preferably hydrogen or $CH_3$.

Suitable N-ethyl-carboxylic acid amides of the formula III are, for example, N-ethyl-formamide, N-ethyl-acetamide, N-ethyl-propionamide, N-ethyl-butyramide, N-ethyl-benzamide, preferably N-ethyl-formamide and N-ethyl-acetamide.

Alcohols to be used in the process of the invention are, like in the process of BE-PS No. 837,906, mainly $C_1$–$C_6$-alkanols such as methanol, ethanol, n-propanol, isopropanol, n-butanol, sec. butanol, preferably methanol and ethanol and more preferably methanol.

The anode material in the process of the invention is commercial, vitreous carbon. Suitable cathode materials are the usual non-noble metals such as steel, nickel and the like.

In the electrolysis according to the invention alkali metal and/or tetraalkyl ammonium alkosulfates are used as supporting electrolyte. As alkali metal ions of said salts all alkali metal ions (Li, Na, K. Rb, Cs) are suitable, although the ions of Na and K are preferred.

The alkyl groups in the tetraalkyl ammonium salts are mainly those having 1 to 6 carbon atoms, preferably methyl and ethyl. Tetramethyl ammonium salts are particularly suitable.

Alkosulfates are salts of sulfuric acid alkyl semiesters. In the present process the $C_1$–$C_6$alkyl and especially the methyl and ethyl semi-esters are preferred.

As supporting electrolytes suitable in the process of the invention the following compounds are named by way of example: sodium methosulfate, potassium methosulfate, lithium methosulfate, etc..

tetramethyl ammonium methosulfate, methyltriethyl ammonium methosulfate, methyltripropyl ammonium methosulfate, methyltri-n-butyl ammonium methosulfate, methyltriamyl ammonium methosulfate, methyltrihexyl ammonium methosulfate, tetraethyl ammonium methosulfate, ethyltrimethyl ammonium methosulfate, ethyltripropyl ammonium methosulfate, ethyltri-n-butyl ammonium methosulfate, methyltriamyl ammonium methosulfate, ethyltrihexyl ammonium methosulfate etc.. Preferred supporting electrolytes are tetramethyl ammonium methosulfate and tetraethyl ammonium methosulfate and especially tetramethyl ammonium methosulfate. The supporting salts can be used individually or in admixture with one another. The starting solution for electrolysis contains the amide III and the supporting electrolyte in alcoholic solution. It proved advantageous to operate with a molar proportion of N-ethyl-carboxylic acid amide to alcohol of about 1:1 to about 1:100, preferably 1:2 to about 1:60 and more preferably 1:5 to about 1:50.

The concentration of supporting electrolyte in the total electrolysis solution is suitably in the range of from about 0.1 to about 40% by weight, preferably about 5 to about 20% by weight.

The supporting electrolyte is usually added after preparation of the alcoholic solution although the sequence can be reversed.

It is not necessary to operate in the absolute absence of water since small moisture contents do not affect the reaction.

To carry out the electrolysis according to the invention a current quantity of at least about 2.5 Faraday/mol of carboxylic acid amide is used. It is possible to use smaller current quantities, but in this case the conversion of starting amide III is diminished.

The current density is preferably adjusted between about 10 and 1,000 mA/cm$^2$, more preferably about 20 and 600 mA/cm$^2$. Lower current densities are also possible, but they do not involve any advantage, on the contrary, they slow down the product formation.

The electrolysis is preferably carried out at a temperature below the boiling temperature of the respective alcohol and above the melting temperature of the electrolysis solution. In general, temperatures of from about −10° to +100° C., preferably about 0° to 60° C. are used.

The electrolysis is normally carried out at atmospheric pressure, although it is also possible, without any advantage, to operate under reduced or elevated pressure.

To avoid the formation of explosive gas mixtures of hydrogen formed in the electrolysis and air, it is recommended to operate under an inert gas, for example nitrogen.

The process can be optimized with respect to energy efficiency and product yield by a high conversion rate of the N-ethyl-carboxylic acid amide, for example more than 99%, which is very advantageous for the working up of the electrolysis solution. Hence, electrolysis is, in general, continued until pratically all starting product has been reacted, so that a later separation thereof from the reaction product is unnecessary. When the desired current quantity has been passed through, the electrolysis current is switched off, the electrolysis mixture is freed from supporting electrolyte and worked up in known manner, preferably by distillation. The reaction product of the electrolysis may be examined as to its purity, for example by nuclear magnetic spectroscopy.

BRIEF DESCRIPTION OF THE DRAWING

To carry out the process of the invention discontinuously the electrolysis cell (1) as shown in the annexed drawing can be used. The cell is provided with a hermetic cover (2) through which the current feeds for the electrodes (3) and (4) are passed and which is provided with inlet (5) for the supply of the electrolysis solution, outlet (6) for the removal of gas and with an orifice (11) for a thermometer (9). The outlet for the gas can be connected to a reflux condenser in which evaporated constituents of the electrolysis mixture can be condensed again.

The electrolysis cell is surrounded by a jacket with inlet (7) and outlet (8) for a circulating heating or cooling liquid. The temperature of the electrolysis solution is controlled by thermometer (9) or by a temperature probe. The two electrodes, i.e. anode (3) and cathode (4) are arranged at a distance of 0.5 to 50 mm, preferably 1 to 15 mm, from each other. The anode material is vitreous carbon and the cathode is made from a non-noble metal, for example nickel or a metal alloy such as stainless steel. The electrodes can be arranged not only in vertical position but also in horizontal position. A combination of several electrode pairs is also possible, especially as proved useful in a blocklike combination of angular and non angular capillary split electrodes with and without vibration of the electrodes. Alternatively, the use of electrodes in bipolar connection is possible. During the course of electrolysis the solution is vigorously mixed, especially in the block-like combinations, by a stirrer, for example a magnetic stirrer (10) or by circulation by pumping.

With continuous operation of the process of the invention cover (2) of the electrolytic cell (1) is provided with a further opening for continuous circulation by pumping of the electrolysis solution. Part of the circulated electrolysis solution is continuously separated for product work-up. To this end the proportion of desired reaction product to starting material is determined in the electrolysis solution, for example by NMR spectroscopy or gas chromatography, whereupon the solution is worked up in known manner. The starting components recovered in the distillation are adjusted again to the molar porportion used and added to the continuously circulated electrolysis together with the required amount of supporting electrolyte.

The products obtainable by the process of the invention are N-α-alkoxyethyl-carboxylic acid amides which, when starting from the preferred compounds of the formula III, have the following formula XII

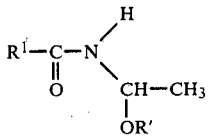

(XII)

in which $R^1$ is as defined under formula III and

R' is $C_1$–$C_6$ alkyl, preferably $CH_3$ or $C_2H_5$ and more preferably $CH_3$.

The process of the invention has the special advantage that in contrast with the wear also known for electrodes of vitreous carbon, (cf. N. L. Weinberg "Technique of Electroorganic Synthesis", volume 5, part 1, page 19, paragraph 2, edited by John Wiley 1972) practically no wear is observed in the electrolyte system used in this case. Moreover, no disturbing and insoluble deposit forms at the cathode. Because of the higher solubility in alcohols of the supporting electrolytes used according to the invention, considerably higher current densities may be used than in the known processes mainly operating with tetrafluoroborates, hexafluorophosphates and nitrates which are less soluble in alcohols, so that higher conversion rates are possible within shorter periods of time.

Hence, the present invention offers a considerable progress. In the same manner as the open-chain N-ethylcarboxylic amide, cyclic N-compounds as used in the processes of BE-PS Nos. 845,001 and 849,625 can be alkoxylated by the proces of the invention, that is with the use of vitreous carbon as anode material and of alkali metal and/or tetraalkyl ammonium alkosulfates as supporting elecrolytes, whereby the products specified in the two specifications are obtained.

The following examples illustrate the invention.

EXAMPLE 1 to 7

An electrolytic cell as shown in the annexed drawing, having a capacity of about 500 cc and provided with cover and reflux condenser, is charged with a mixture of the respective carboxylic acid amide and the respective alcohol in which the supporting electrolyte is dissolved. One plate each of steel and vitreous carbon (width x length $50 \times 130$ mm$^2$—are arranged at a distance of 3 to 5 mm from each other in a manner such that they are immersed 100 mm in the solution. During electrolysis the content of the cell is stirred by a magnetic stirrer at a rate of 50 to 60 rpm and maintained at the value T indicated in the following Table 1. After having passed through the current quantity Q also indicated in the table, the current is switched off.

The electrolysis solution is worked up in known manner.

The results of Examples 1 to 7 are summarized in the following Table 1.

TABLE 1

| Example | amide $R^1CONHC_2H_5$ | | alcohol R'OH | | supporting | | elektrolysis data | | | | | yield | |
|---|---|---|---|---|---|---|---|---|---|---|---|---|---|
| No. | $R^1$ | [g] | R' | [g] | electrolyte | [g] | $\bar{J}$ | $\bar{U}$ | Q | T | product | M | S |
| 1 | H | 100 | $CH_3$ | 250 | tetra-methyl ammonium methosulfate | 50 | 50 | 12.3 | 3.0 | 45 | N-(α-methoxy-ethyl)-formamide | 74.1 | 49.4 |
| 2 | H | 100 | $CH_3$ | 250 | sodium methosulfate | 15 | 45 | 29.9 | 3.8 | 20 | N-(α-methoxy-ethyl)-formamide | 72.0 | 37.9 |
| 3 | H | 100 | $CH_3$ | 250 | potassium methosulfate | 9 | 45 | 50.1 | 3.1 | 10 | N-(α-methoxy-ethyl)-formamide | 70.9 | 45.7 |
| 4 | $CH_3$ | 100 | $C_2H_5$ | 263 | tetramethyl ammonium methosulfate | 50 | 30 | 47.3 | 4.2 | 10 | N-(α-ethoxy-ethyl)-acet-amide | 52.1 | 24.8 |
| 5 | $CH_3$ | 100 | $C_2H_5$ | 263 | tetra-ethyl ammonium ethosulfate | 60 | 30 | 29.2 | 4.8 | 30 | N-(α-ethoxy-ethyl)-acetamide | 51.3 | 21.4 |
| 6 | $CH_3$ | 90 | n-$C_4H_9$ | 300 | tetra-methyl ammonium metho-sulfate | 30 | 20 | 49.2 | 4.8 | 30 | N-(α-n-butoxy-ethyl)-acetamide | 45 1 | 18.8 |
| 7 | $C_2H_5$ | 60 | $CH_3$ | 300 | tetra-methyl ammonium metho- | 45 | 20 | 19.9 | 4.0 | 20 | N-(α-methoxy-ethyl)-propion- | 80.3 | 40.2 |

TABLE 1-continued

| Example No. | amide $R^1CONHC_2H_5$ $R^1$ | [g] | alcohol R'OH R' | [g] | supporting electrolyte | [g] | elektrolysis data $\bar{J}$ | $\bar{U}$ | Q | T | product | yield M | S |
|---|---|---|---|---|---|---|---|---|---|---|---|---|---|
| | | | | | sulfate | | | | | | amide | | |

$\bar{J}$ = current [mA/cm²]
$\bar{U}$ = average cell voltage [V]
Q = current amount [Faraday/mol Amide]
T = cell temperature [°C.]
M = material yield [% of the theory]
S = current efficiency [%]

EXAMPLES 8 to 10

An undivided electrolytic cell with block-line electrode combination is mounted in a flow apparatus with circulating pump, heat exchanger and degassing vessel. The electrode combination consists of an anode of vitreous carbon, a cathode of steel and therebetween 4 electrode plates in bipolar arrangement made of vitreous carbon. Between these plates there is inserted each time a pile of nickel nets (2 layers with a mesh width of 0.19 mm, 0.1 mm wire thickness, therebetween two layers of a mesh width of 0.5 mm and a wire thickness of 0.3 mm) and of polyethylene fabric (one layer of a mesh width of 0.9 mm and a filament thickness of 0.3 mm) in such a manner that the nickel nets lie on the cathode sides of the carbon plate and on the steel plate. To minimize the electrode distance, the combinations are compressed. All electrode plates are framed in a polyethylene frame having a width of 22 mm vertically to the direction of flow of the electrolyte, of 12 mm parallel to the direction of flow and a thickness of about 2.5 mm like each plate. The efffective electrode surface of each anode is 255 cm².

The conditions and results of the examples carried out in this apparatus are indicated in the following Table 2.

TABLE 2

| Example No. | amide $CH_3CONHC_2H_5$ | [g] | R'OH R' | [g] | supporting electrolyte | [g] | electrolysis data $\bar{J}$ | $\bar{U}$ | Q | T | product | yield M | S |
|---|---|---|---|---|---|---|---|---|---|---|---|---|---|
| 8 | " | 4830 | $CH_3$ | 6485 | tetra-methylam-monium metho-sulfate | 2485 | 157 | 30 1 | 2 8 | 48 | N-(α-Methoxy-ethyl)-acetamide | 86.5 | 61.8 |
| 9 | " | 2000 | " | 10000 | tetra-methylam-monium metho-sulfate | 3000 | 179 | 25 8 | 3 0 | 37 | N-(α-Methoxy-ethyl)-acetamide | 89.3 | 59.5 |
| 10 | " | 6000 | " | 1000 | tetra-methylam-monium metho-sulfate | 3750 | 153 | 26 3 | 2 6 | 46 | N-(α-Methoxy-ethyl)-acetamide | 91.9 | 70.7 |

explanation of legends of Table 1

What is claimed is:

1. A process for the manufacture of N-α-alkoxyethyl-carboxylic acid amides in an electrolysis solution which comprises alkoxylation of an N-ethyl-carboxylic acid amide with an alcohol in an electrolytic cell equipped with an anode and a cathode in the presence of a supporting electrolyte, using vitreous carbon as anode material and at least one alkali metal, or tetraalklammonium alkosulfate as supporting electrolyte.

2. The process of claim 1, wherein compounds of the formula

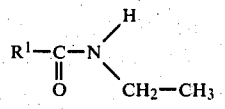

(III)

in which $R^1$ is hydrogen, $C_1$–$C_6$ alkyl or $C_6$–$C_{10}$ aryl are used as the N-ethyl-carboxylic acid amide.

3. The process of claim 1 or 2, wherein a $C_1$–$C_6$ alkanol is used as the alcohol.

4. The process of claim 3, wherein sodium or potassium metho- or ethosulfate is used as the alkali metal alkosulfate.

5. The process of claim 4, wherein a $C_1$–$C_6$ alkyl ammonium metho- or ethosulfate is used as the tetraalkyl ammonium alkosulfate.

6. The process of claim 2, wherein $R^1$ is hydrogen or $CH_3$.

7. The process of claim 3, wherein the alcohol is methanol or ethanol.

8. The process of claim 7, wherein the alcohol is methanol.

9. The process of claim 5, wherein tetramethyl ammonium methosulfate is used as the tetraalkyl ammonium alkosulfate.

10. The process of claim 1, wherein the alkali metal is sodium or potassium.

11. The process of claim 1, wherein the molar proportion of N-ethyl-carboxylic acid amide to alcohol is 1:5 to 1:50 and the concentration of electrolyte is in the range of 5 to 20 percent by weight, based on the weight of the electrolysis solution.

12. The process of claim 11, wherein the process is carried out using a current quantity of at least 2.5 Faraday/mol of carboxylic acid amide.

13. The process of claim 12, wherein the current density is adjusted to between 10 and 1,000 mA/cm².

* * * * *